United States Patent [19]

Storey

[11] 4,006,287

[45] Feb. 1, 1977

[54] WELDING CABLE

[75] Inventor: John Thomas Storey, Northolt, England

[73] Assignee: Delta Metal Electronics Limited, Northolt, England

[22] Filed: Mar. 15, 1973

[21] Appl. No.: 341,591

[30] Foreign Application Priority Data

Mar. 16, 1972 United Kingdom ..... 12284/72

[52] U.S. Cl. ..... 174/15 WF; 174/130; 174/131 R

[51] Int. Cl.[2] ..... H01B 7/34

[58] Field of Search ..... 174/129, 130, 131 R, 174/119 R, 114 R, 15 C, 113 R, 15 WF, 133 R; 57/148

[56] References Cited

UNITED STATES PATENTS

| | | | |
|---|---|---|---|
| 1,943,087 | 1/1934 | Potter | 174/128 X |
| 1,999,273 | 4/1935 | Austin | 174/128 |
| 2,197,544 | 4/1940 | Atkinson | 170/130 X |
| 2,217,276 | 10/1940 | Hill | 174/130 X |
| 2,222,574 | 11/1940 | Roberston | 174/130 UX |
| 3,079,460 | 2/1963 | Groue | 174/128 |
| 3,339,012 | 8/1967 | Hutchins | 174/130 |

*Primary Examiner*—E. A. Goldberg

[57] ABSTRACT

An electrical conductor particularly suitable for resistance welding equipment comprises an even number and at least four bunches of helically wound electrically conductive strands arranged in side-by-side contacting relation with a hollow central passage through the conductor and wherein the strands of each bunch are twisted in the opposite direction to the strands of the two bunches in contact therewith so as to provide zero electrical wear points in the cross section of the conductor. In one embodiment there are six bunches of strands surrounded by a further twelve bunches of helically wound strands arranged in side-by-side contacting relation with the strands of each outer bunch twisted in the opposite direction to the strands of the two outer bunches in contact therewith.

11 Claims, 6 Drawing Figures

WELDING CABLE

Figure 1:
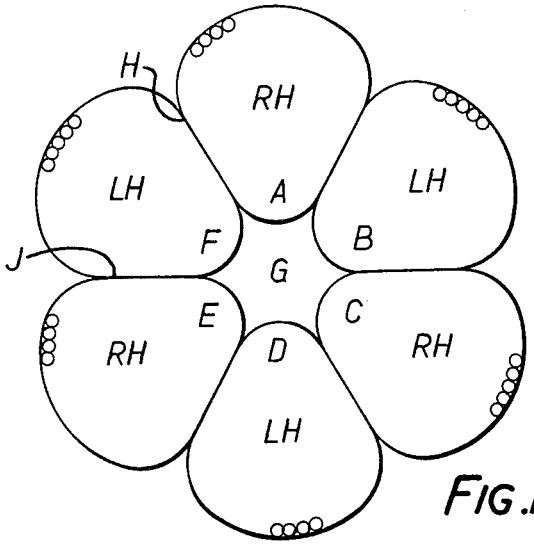

This invention relates to electrical conductors capable of carrying very high electrical currents, for example, conductors suitable for connecting a low voltage transformer to a resistance welding head. Conductors of this type usually have to carry currents in the order of 4,000 to 20,000 amperes at a very low voltage and the duration of the flow of current is normally between 1 and 25 cycles of the supply frequency.

In order to give the conductor sufficient flexibility to enable it to be used with welding equipment the conductors have to be formed from a very large number of fine strands of soft copper. The strands are twisted together and when the current carried by the conductor is varied the magnetic fields induced about each of the strands is also varied and react with one another creating magnetically induced forces and resultant movements of the individual strands of the conductor.

In U.S. Pat. No. 3079460 there is described a welding cable constructed so as to reduce the resultant movement of the individual strands from which the conductor is formed and to therefore extend the useful life of the conductor. The cable consists of a core and a plurality of bunches of strands, the bunches being arranged in at least two peripheral layers concentrically surrounding the core. The layer adjacent the core consists of six bunches each contacting the core and the outer layer consists of twelve bunches. The helical arrangement of all the bunches in all the layers are alike in direction and angle and the strands of each bunch are twisted in the opposite directional sense to the strands in the next adjacent bunch in the same layer.

Breakdown of the strands of the cable is likely to occur at a number of points in the cross section of the cable, these points being known as electrical wear points. These wear points exist where the strands constituting one bunch contact the strands constituting the adjacent bunch and where the direction of twist of the two bunches is the same. Clearly it is advantageous to design the electrical cable to reduce the number of wear points to a minimum. In the cable described in the above mentioned U.S. specification there are six wear points between the bunches of the outer layer and those of the inner layer and three more wear points between the bunches of the inner layer and core.

Although the above described cable was an improvement over cables known before its time, it is an object of the present invention to provide a cable construction which has advantages over the above mentioned cable.

According to the present invention an electrical conductor comprises an even number and at least four bunches of strands of electrically conductive material wound together in a helical manner with the bunches arranged in side by side contacting relation with a hollow central passage through the conductor and wherein the strands of each bunch are twisted in the opposite direction to the strands of the two bunches in contact therewith so as to provide zero electrical wear points in the cross section of the conductor.

Preferably there are six bunches of strands arranged in side by side contacting relation and since there is a hollow central passage and a core conductor is not provided the number of wear points in the cross section of the cable is zero.

The bunches of strands may be of non circular cross section with each bunch having a pair of flat surfaces which contact the two bunches on opposite sides thereof.

An electrical conductor consisting of six bunches of strands as described above may have a further twelve bunches of strands of electrically conductive material wound together in a helical manner in a side by side contacting relation to surround said six bunches of strands which serve as a core and the strands of each of the outer twelve bunches are twisted in the opposite direction to the strands of the two outer bunches in contact therewith so as to provide zero electrical wear points between the outer twelve bunches in the cross section of the conductor and the inner six bunches and the outer twelve bunches are arranged to have six electrical wear points between them in the cross section of the conductor.

Although the lay of the inner six bunches of conductors may be in the same direction as the lay of the outer twelve bunches of conductors it is preferable for the lay of the inner six bunches to be in the opposite direction to the lay of the outer twelve bunches.

The provision of a hollow central passage through the conductor has an advantageous effect on the A.C. conductivity of the conductor since it is well known that when an alternating current flows in a conductor, the resultant electro magnetic induction causes the current density to be less in the center of the conductor and greater on the outside. Hence a conductor having a hollow central passage has a smaller A.C. resistance than a solid conductor of the same cross-sectional area.

A further advantage which conductors according to the present invention possess over the known conductors is that as the number of wear points are reduced the flexibility of the conductor is improved because the wear points are a source of friction between the strands and by reducing the number of wear points the internal friction of the conductor is reduced.

An electrical cable rope may comprise eighteen of the electrical conductors as described above with six of the conductors wound together in a helical manner to form a core with the conductors arranged in side by side contacting relation with a hollow central passage through the rope and with each conductor twisted in the opposite direction to the two conductors in contact therewith and the other twelve conductors wound together in a helical manner in side by side contacting relation to surround said core and with each of the outer conductors twisted in the opposite direction to the two outer conductors in contact therewith. The lay of the inner six conductors is preferably in the opposite direction to the lay of the outer twelve conductors.

An electrical cable may comprise an even number of the cable ropes of the 18 × 18 construction or eighteen of the electrical conductors of 6 × 12 construction contained in an insulating outer casing with one half of the ropes or conductors being of one polarity and the other half being of the other polarity and with a body of electrically insulating material separating the ropes or conductors of one polarity from those of the other polarity.

Figure 2:
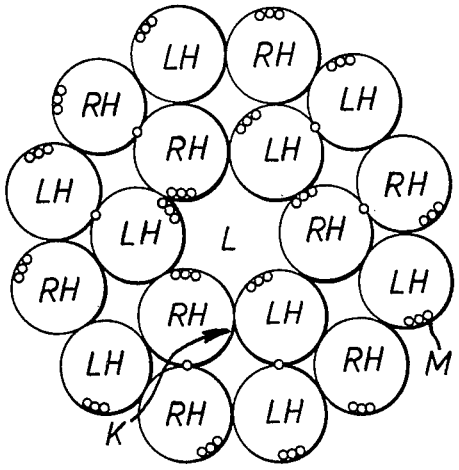
Figure 3:
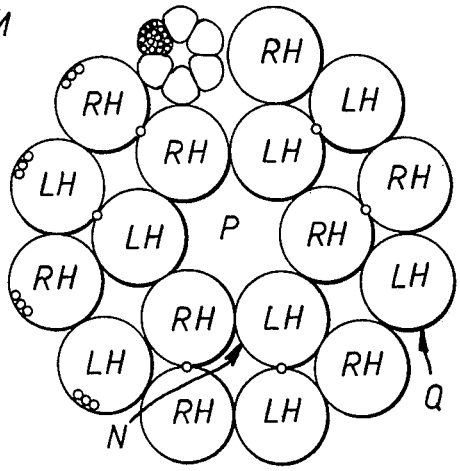
Figure 4:
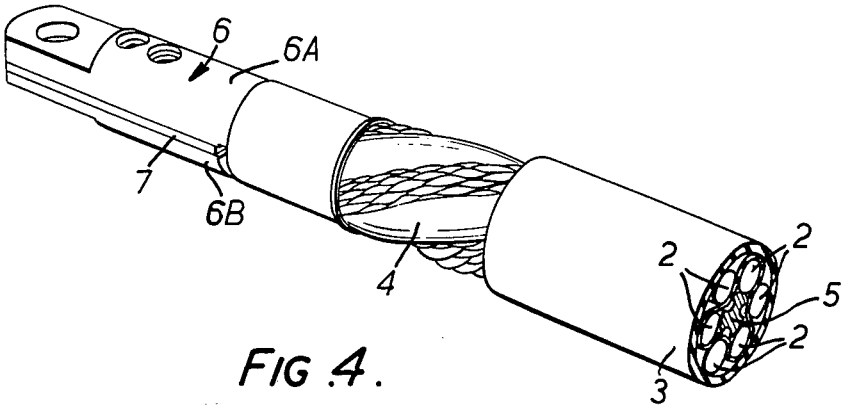
Figure 5:
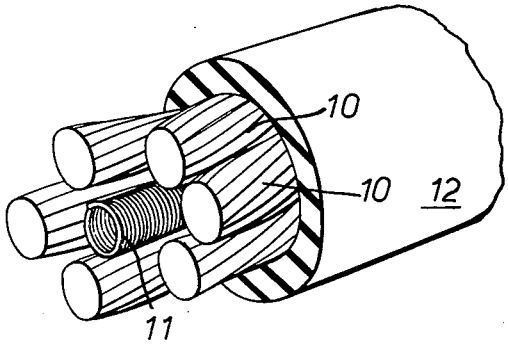
Figure 6:
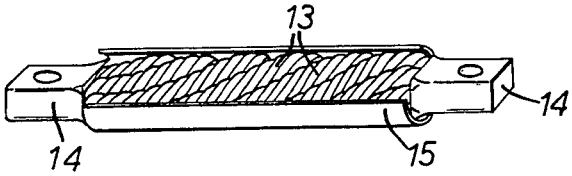

In order that the invention may be more readily understood it will now be described, by way of example only, with reference to the accompanying drawings in which:

FIG. 1 is a diagrammatic cross-section of an electrical conductor unit consisting of six bunches of strands of electrically conductive material, FIG. 2 is a diagrammatic cross-section of an electrical conductor unit consisting of eighteen bunches of strands of electrically conductive material, FIG. 3 is a diagrammatic cross section of a cable rope consisting of eighteen electrical conductor units each as shown in FIG. 1, FIG. 4 is a perspective view of an end portion of an electrical cable, FIG. 5 is a perspective view of an end portion of a water cooled electrical jumper, and FIG. 6 is a perspective view of a dry electrical jumper.

Referring to FIG. 1 an electrical conductor unit has six bunches A, B, C, D, E and F, of strands of copper wire of say .25 mm diameter. Each bunch may consist for example of 16 to in the order of 130 strands. The bunches of strands are wound in a helical manner to form the conductor with the bunches arranged in side by side contacting relation and with a hollow central passage G extending through the conductor. The strands of each bunch are initially arranged so that the bunch is of generally circular cross section but when the bunches are wound together there is very limited area of contact between adjacent bunches. The wound conductor is passed through a die to force the bunches together so that the bunches then become of non circular cross section and each bunch has a pair of flat surfaces H and J which provide a larger area of contact with the two bunches on opposite sides thereof. The strands in the bunches are wound in a helical manner with the strands A, C and E having right hand lay and the strands of bunches B, D and F are wound with a left hand lay. When the bunches are brought together to form the conductor the strands in each bunch are twisted in the opposite direction to the strands of the two bunches in contact therewith and in this way there are no electrical wear points in the cross section of the conductor.

FIG. 2 shows an electrical conductor unit of an alternative form in which six bunches of strands of copper wire are wound together in a helical manner in side-by-side contacting relation to form a core K having a central passage L extending through it. The lay of the strands in each of the bunches making up the core are arranged in opposite directions for adjacent conductors so that there are zero wear points between the conductors making up the core. These six conductors are surrounded by a further twelve conductors M and alternate conductors have the same lay so that there is zero wear points between the conductors forming the group M. It can be seen from FIG. 2 that there are only six wear points between the conductors constituting the core and the conductors of the outer group.

Referring now to FIG. 3, a balanced electrical rope consists of eighteen conductor units each consisting of either six bunches as shown in FIG. 1 or eighteen bunches as shown in FIG. 2. The eighteen conductors are arranged with an inner group N of six conductors arranged in side by side contacting relation with a hollow passage P extending centrally of the rope and the lay of the individual conductors are in opposite directions for each pair of adjacent conductors making up the core. A further twelve conductors Q surround the core and are in side by side contacting relation with alternate conductors having opposite lay so that there are zero wear points between the conductors of the outer group. Again it can be seen from FIG. 3 that there are six wear points between the conductors of the core N and the outer group of conductors Q.

An electrical cable as shown in FIG. 4 consists of an even number of cable ropes 2, typically six ropes each as shown in FIG. 3 within an insulating outer sheath 3 with one half of the ropes being arranged to be of one polarity and the other half being arranged to be of the other polarity when the cable is in use, and a body of electrically insulating material 4 separates the two groups of cables. In a preferred arrangement there are six cable ropes in the cable, the ropes being arranged side-by-side around a fluted core 5 with alternate ropes being of opposite polarity. Terminals 6 are provided at each end of the cable and each terminal is in two parts 6A, 6B separated by a body of insulating material 7. The ropes of one polarity are connected to one of the parts and the ropes of the other polarity are connected to the other part. Provision is made for passing cooling water along the length of the cable to cool it when it is in use.

An electrical jumper is a conductor of a single polarity. A jumper having provision for liquid usually water, cooling is shown in FIG. 5. Six conductors 10 each as shown in FIG. 2 or ropes as shown in FIG. 3 are arranged around a metal spiral 11. The spiral serves as a duct for cooling water and the conductors are enclosed in an insulating and water containing sheath 12. An air cooled jumper is shown in FIG. 6 and comprises seven ropes 13, each as shown in FIG. 3 with six ropes twisted together in a helical manner around a central rope and with the ends of the ropes pressed in a die to form generally rectangular blocks 14. An insulating sheath 15 of rubber or the like is fitted around the ropes. As an alternative to a metal spiral a fluted rubber core or similar device could be employed.

I claim:

1. An electrical cable rope comprising eighteen electrical conductor units with six of the conductor units wound together in a helical manner to form a core with the conductors arranged in side-by-side contacting relationship, a hollow central passage being directed through the core, each conductor unit being twisted in the opposite direction to the two conductor units in contact therewith, the other twelve conductor units being wound together in a helical manner in side-by-side contacting relationship to surround said core, each of the outer conductor units being twisted in the opposite direction to the two outer conductor units in contact therewith and with each conductor unit comprising an even number of bunches of strands of electrically conductive material, said number of bunches being at least four and being arranged in side-by-side contacting relationship to define a hollow central passage through the unit, the strands of each bunch being wound together in a helical manner and in the opposite direction to the strands of the two bunches in contact therewith so that zero electrical wear points prevail in the cross-section of the unit.

2. An electrical cable rope as claimed in claim 1 wherein each of the conductor units comprises eighteen bunches of strands with six of the said bunches of strands being arranged in side-by-side contacting relationship to define a core having a hollow central passage therethrough, the strands of each bunch being wound together in a helical manner and in the opposite direction to the strands of the two bunches in contact therewith so that zero electrical wear points prevail in the cross-section of the core and the further twelve bunches of strands are wound together in a helical manner in side-by-side contacting relationship to surround said six bunches of strands serving as the core, the strands of each of the outer twelve bunches being twisted in the opposite direction to the strands of the two outer bunches in contact therewith so that zero electrical wear points prevail between the outer twelve bunches in the cross-section of the unit, the inner six bunches and the outer twelve bunches being arranged to have six electrical wear points between them in the cross-section of the said conductor unit.

3. An electrical cable rope as claimed in claim 2 wherein the lay of the inner six bunches of strands in each conductor unit is in the opposite direction to the lay of the outer twelve bunches of strands.

4. An electrical cable rope as claimed in claim 1 wherein said bunches of strands are of non-circular cross-section, each bunch having a pair of flat faces contacting two bunches on opposite sides thereof.

5. An electrical cable comprising an even number of the cable ropes claimed in claim 1 wound together in a helical manner and contained in an insulating outer casing with one half of the ropes being arranged to be of one polarity and the other half being arranged to be of the other polarity and a body of electrically insulating material separating them.

6. An electrical cable as claimed in claim 5 wherein the cable is terminated at each end by a two-part terminal, the parts being separated by electrically insulating material, with the ropes of one polarity connected to one part of the terminal and the ropes of the other polarity connected to the other part of the terminal.

7. An electrical jumper comprising an even number and at least four cable ropes each as claimed in claim 1 arranged around a central duct for carrying a liquid coolant and with an outer insulating sheath surrounding the cable ropes.

8. An electrical cable rope as claimed in claim 2 wherein the lay of the inner six conductor units is in the opposite direction to the lay of the outer twelve conductor units.

9. An electrical conductor arrangement comprising an even number and at least six cable ropes each as claimed in claim 1 arranged in a helical manner around a further cable rope and having their corresponding ends joined together.

10. An unsheathed flexible electrical conductor unit for welding machines with substantially heavy currents, comprising an even number of bunches of strands of electrically conductive material, said number of bunches being at least four and being arranged in side-by-side relationship and in contact with each other to define a central vacant passage through the unit, the strands of each bunch being wound together in a helical manner and in the opposite direction to the strands of two bunches in contact therewith so that zero electrical wear points prevail in the cross-section of the unit, said conductor unit comprising six bunches of strands; a further twelve bunches of strands of electrically conductive material wound together in a helical manner in side-by-side contacting relationship to surround said six bunches of strands serving as a core, the strands of each of the outer twelve bunches being twisted in the opposite direction to the strands of the two outer bunches in contact therewith so that zero electrical wear points prevail between the outer twelve bunches in the cross-section of the conductor, the inner six bunches and the outer twelve bunches being arranged to have six electrical wear points between them in the cross-section of said conductor; the lay of the inner six bunches of strands being in the opposite direction to the lay of the outer twelve bunches of strands; an insulating outer casting containng said even number of conductors, one half of the conductors being arranged to be of one polarity and the other half being arranged to be of the other polarity and a body of electrically insulating material separating them.

11. An electrical cable as claimed in claim 8 wherein the cable is terminated at each end by a two-part terminal, the parts being separated by electrically insulating material with the conductors of one polarity connected to one part of the terminal and the conductors of the other polarity connected to the other part of the terminal.

* * * * *